US005161612A

United States Patent [19]

Stafford

[11] Patent Number: 5,161,612

[45] Date of Patent: Nov. 10, 1992

[54] WELL CASING WASH ASSEMBLY

[76] Inventor: Lawrence R. Stafford, 3905 Starwood, Bakersfield, Calif. 93309

[21] Appl. No.: 760,736

[22] Filed: Sep. 16, 1991

[51] Int. Cl.[5] ..... E21B 37/00

[52] U.S. Cl. ..... 166/169; 166/171

[58] Field of Search ..... 166/165-176, 166/110, 311, 312; 15/104.16, 104.17

[56] References Cited

U.S. PATENT DOCUMENTS 3,297,083 1/1967 Taylor ..... 166/169

4,892,145 1/1990 Stafford ..... 166/171 X

*Primary Examiner*—Thuy M. Bui

*Attorney, Agent, or Firm*—I. Michael Bak-Boychuk

[57] ABSTRACT

A water pressure cleaning assembly useful in cleaning out the perforations in a well casing includes a mandrel structure defined by an upper cylindrical segment and a lower conical segment. An upper and lower annular seal is movable respectively along the upper and lower segments to allow relative motion of the mandrel structure within the annuli thereof. This lateral motion then allows the passage of the assembly across irregularities in the casing.

3 Claims, 2 Drawing Sheets

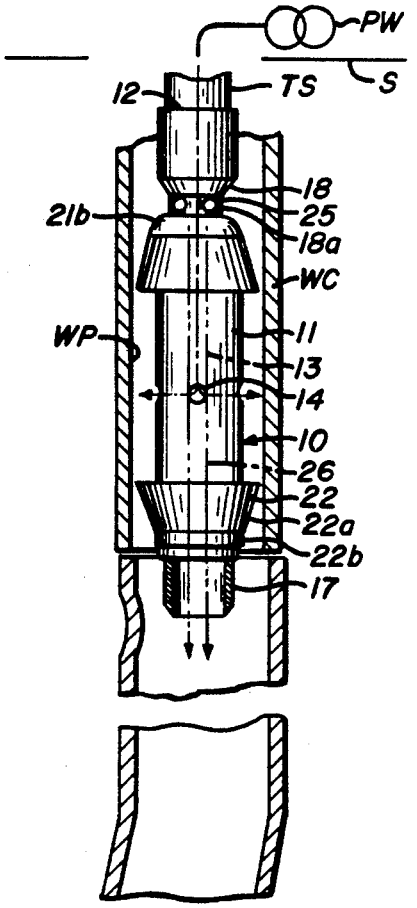
FIG-.1
(PRIOR ART)
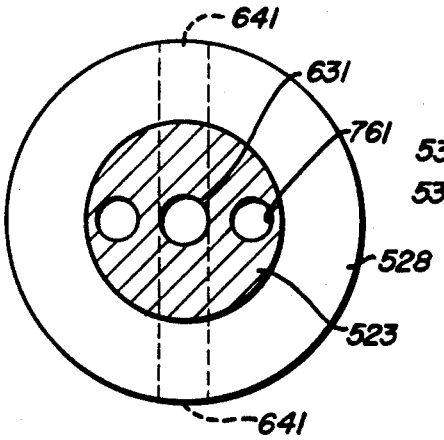
FIG-.4
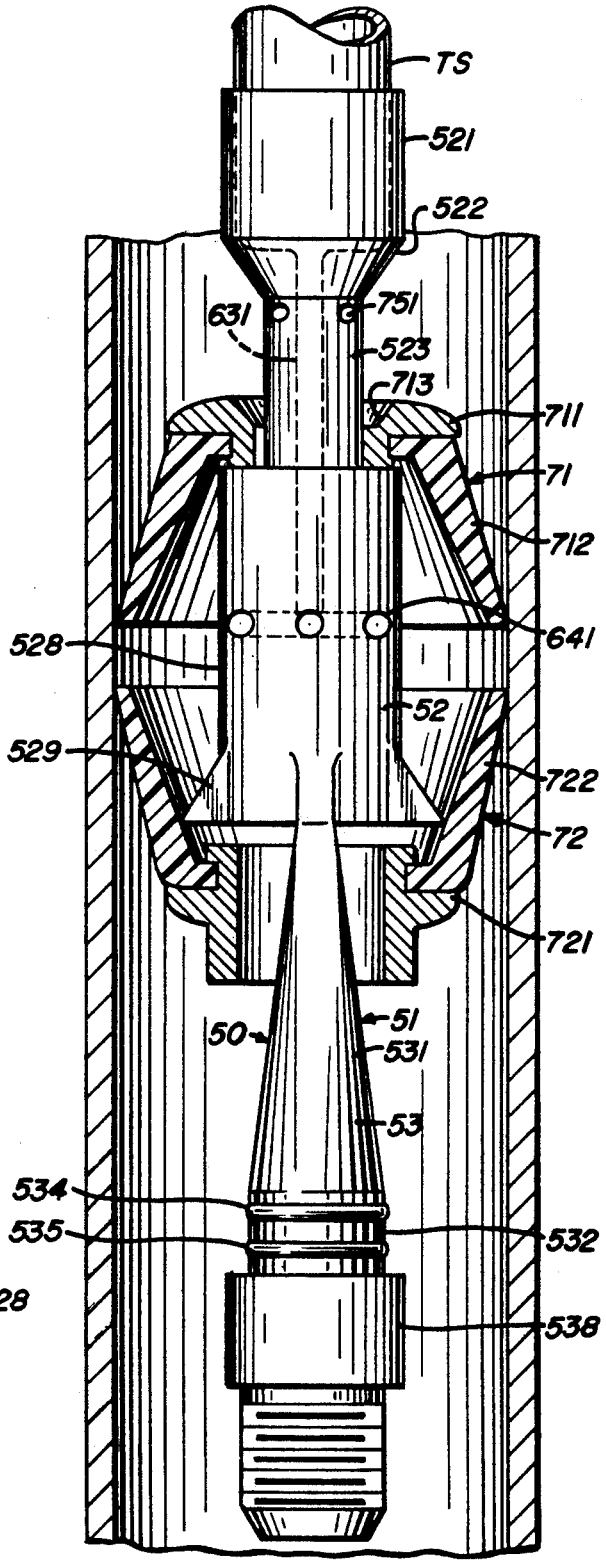
FIG-.2

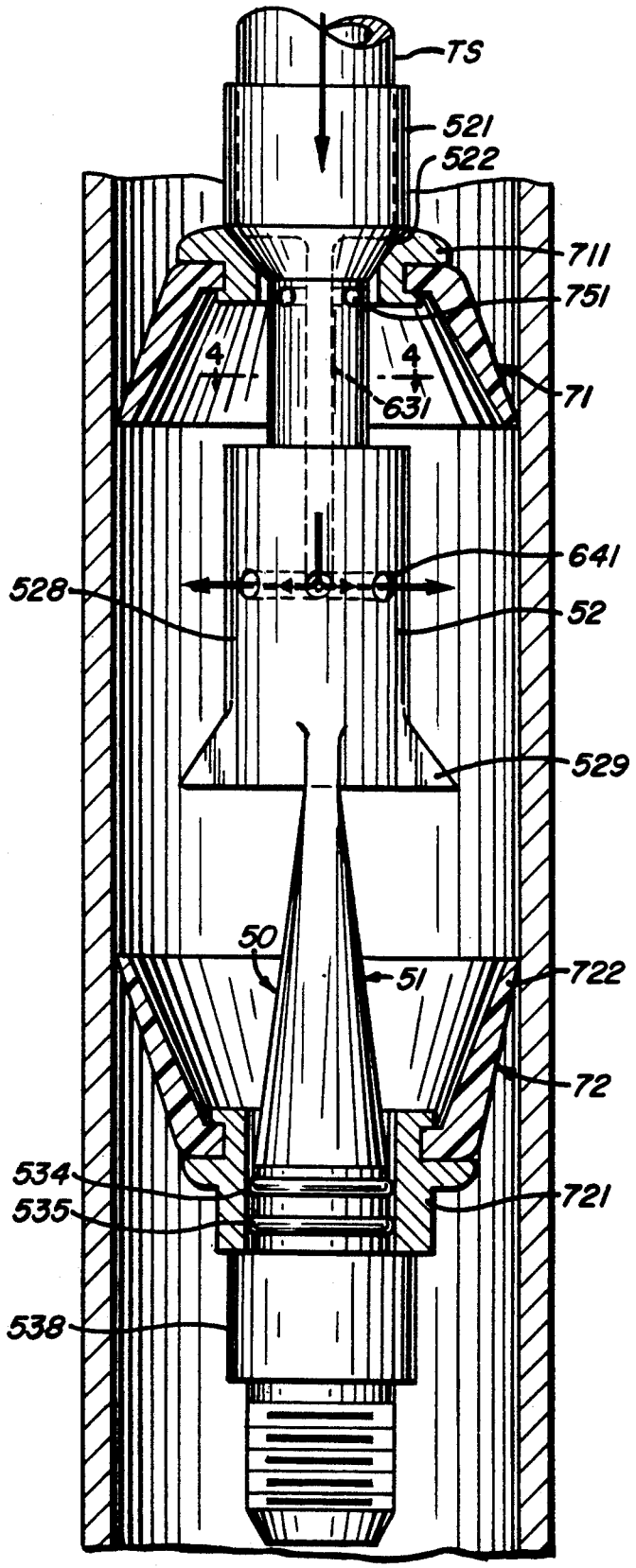
FIG—.3

WELL CASING WASH ASSEMBLY

BACKGROUND OF THE INVENTION

1. Field of the Invention

The present invention relates to well bore cleaning assemblies and more particularly to clean out assemblies for cleaning well casing perforations by water pressure.

2. Description of the Prior Art

In my prior U.S. Pat. No. 4,892,145, issued on Jan. 9, 1990, I have described a new, mechanical, clean out tool for opening well perforations in a well casing. This tool is particularly useful in fracturing solid debris collected and blocking the casing perforation.

In the course of pumping well fluids from any ground formation silt, sand, and other particulate matter migrate to the well bore and then deposit at the perforations in the casing. Eventually this accumulation closes off the flow and the well becomes unproductive. Thus periodic cleanout is necessary and, depending on the form and chemistry of the accumulate, this cleanout may require mechanical or water flow mechanisms, or both.

One mechanical arrangement has been referred to above and reference is therefore invited to the teaching of my prior U.S. Patent for the manner of operation of such a device. Water based cleanout devices in the prior art typically take the form of a manifolded mandrel tied to the end of a hollow rod string through which water, at pressure, is conveyed into the well bore. To confine this water pressure to the mandrel length, an upper and lower resilient thimble seal are provided.

These prior devices, while suitable for the purposes intended, occasionally hang up and are opposed in their passage by offset partings in the casing, occasional collapse in the casing walls, or bends or dog legs in the bore.

Thus a water cleaning assembly that passes these occasional defects is extensively sought and it is one such assembly that is disclosed herein.

SUMMARY OF THE INVENTION

Accordingly, it is the general purpose and object of the present invention to provide a water bearing well cleaning assembly conformed for passage across casing irregularities.

Other objects of the invention are to provide a water based well cleaning assembly which collapses in its geometry for insertion an removal.

Yet further objects of the invention are to provide a collapsible water flow confinement structure useful for cleaning a well bore.

Briefly these and other objects are accomplished within the present invention by conforming a generally cylindrical mandrel into an upper and lower mandrel segment, the upper segment terminating in a fitting for threaded attachment to the end of a hollow rod string. Each segment, moreover, at the distal ends, forms a seal against which a mating annulus of a cup shaped thimble seal is engaged. The upper segment, along the axial direction down from its seat, forms a generally cylindrical structure expanding into a set of radial projections to oppose the upward progression of the lower cup seal. The lower mandrel segment is generally conical in shape threaded or otherwise attached by its apex to the underside of the upper segment. At its base the lower segment forms the other seal for the annulus of the lower cup seal.

Thus both the upper and lower cup seal are free to move along the axis of the mandrel one displaced from their respective seats. When displaced onto the mandrel the upper cup seal allows for some lateral motion within the limits of the annulus. The lower cup seal, similarly, will allow for lateral motion between the lower mandrel segment and its annulus, which is progressively greater as the cup moves up along the cone. In this manner substantial irregularities in the well casing are accommodated, by lateral displacement of the seals, allowing the insertion and removal of the tool.

Both the upper and lower cup seals may be formed from an elastomeric material, the upper cup being inverted while the lower cup is aligned to present its cavity upwards. Preferably, each cup seal is somewhat smaller in diameter than the nominal inner diameter of the well casing, with sufficient edge compliance to expand, by water pressure, against the casing walls.

The mandrel may be mainifolded along two separate flow paths, one to convey the pressurized water stream through the rod string into the upper segment and thence radially out, and the second for transferring well fluids between a set of ports in the upper tapered seat to an opening at the lower end of the mandrel. Thus, when the upper cup seal is unseated well fluid is free to transfer across the tool, and once the seals are seated the rod string flow, at pressure, is confined between the seals.

BRIEF DESCRIPTION OF THE DRAWINGS

FIG. 1 is a side view, in partial section of a prior art water based well cleaning assembly;

FIG. 2 is yet another side view, in partial section, of the inventive water pressure well cleaning assembly, in the course of passage down a well bore;

FIG. 3 is the side view shown in FIG. 2 with the inventive assembly deployed for cleaning; and FIG. 4 is a sectional view taken along line 4—4 of FIG. 3.

DESCRIPTION OF THE PREFERRED EMBODIMENT

Well bore cleaners have had extensive use and development in the past. In typical configuration such prior art cleaning assemblies take the form illustrated in FIG. 1 and reference thereto is now taken for the functional description of thereof. More precisely such prior art cleaning assemblies, generally indicated at 10, attach to the lower and of a tube string TS which at the surface S may be tied to a source of pressurized water PW to convey this flow of pressurized water against the walls of the well casing WC. A substantially cylindrical mandrel 11 forms the center manifold therefor, the mandrel being generally circular in section, of a radial dimension substantially smaller than the radial dimension of the well. This first manifold comprises an inlet opening 12 threaded to the end of the tube string TS which then communicates into an axial path 13 running partly into the mandrel. A plurality of radial drillings 14, extending through the mandrel to the axial bore, then direct the water flow at the casing walls.

Of course, this flow of pressurized water is most effective when confined. Accordingly, an upper and a lower resilient cup seal, 21 and 22 respectively, are mounted on the upper and lower ends of the mandrel. Each of the seals 21 and 22 comprises a generally dished resilient fitting 21*a* and 22*a* mounted on an annular ring 21*b* and 22*b*. Ring 21*b* corresponding, in turn, engages a tapered seats 18 formed at the upper end of the mandrel. The upper seat 18, furthermore, includes an array of inlet ports 25 which communicate through a separate mainifold 26 into the lower end fitting 17 of the mandrel. This fitting may then be threaded to other downhole devices that may be combined for effective cleaning.

In common practice the upper portion of the mandrel 11 is cut to a reduced section 18*a* adjacent the seat 18, thus allowing for axial translation of the seal 21 away from its seat. Thus any substantial upward movement of the assembly 10 will displace seal 21 from its seat, allowing the well water to equalize through ports 25 and the associated manifold 26.

The lower seal 22 is generally fixed in place, with the inward flexure of the edges of the seal providing pressure relief from below, and thus permits the descent of the tool into the well bore.

In this general form the prior art cleaning assembly 10 provides a confinement for the fluid at pressure, sent down the pipe string. Specifically, seals 21 and 22 are expanded, by the cleaning pressure, against the well walls, this confined fluid pressure is then useful to backwash and open any debris collected at the well perforations WP.

While extremely effective, the foregoing assembly lacks the convenience of passage across irregular ties in the well casing. Thus the seal edges occasionally catch and bind at parting offsets in the basin, at doglegs or bends in the bore, or at inward collapses in the casing walls.

Illustrated in FIGS. 2–4 is my inventive cleaning assembly which resolves each of the foregoing problems. More precisely, as shown in these figures, the inventive cleaning assembly generally designated by the numeral 50, comprises a mandrel assembly 51 including an upper segment 52 and a lower segment 53. The upper segment 52, at its upper distal, end forms into a threaded female fitting 521 conformed to mate with the lower end of the tube string TS. Right below the fitting, mandrel segment 52 tapers down in section to form a tapered seat 522, below which a reduced mandrel section 523 is formed, similar to the reduced section 18*a* in the prior art assemblies.

An annular seal assembly 71 is coaxially mounted on the reduced section 523. Seal assembly 71 is characterised by an annular steel base or collar 711 onto which a resiliant cup seal 712 is fixed. Collar 711, moreover, includes a mating seat surface 713 to seal against the seat 522. Thus seal assembly 71 is free to move from its seating engagement onto the length of the reduced section 523, allowing for both vertical and lateral offset once thus translated.

Below the reduced section 523 the mandrel segment 52 expands to a larger cylinder 528 terminating at its lower end in a set of radial fins or tabs 529. The lower segment 53, in turn, is shaped as a frustoconical structure defined by a cone frustrum 531 attached by its apex to the lower end of segment 52 and terminating in a sealing cylinder 532 at the bottom. Cylinder 532 is provided with a pair of sealing grooves in which sealing rings 534 & 535 are mounted. An enlarged fitting 538 is then formed on the end of the mandrel.

The lower seal assembly 72 comprises a tubular hollow collar 721 from which yet another resilient cup seal 722 extends. The interior dimension of collar 721 conforms for sealing fit against the sealing rings 534 and 535 but is opposed from further downward descent by the structure of fitting 538. Thus seal assembly 72 is free to migrate upwardly onto the reduced conical surface of the frustrum 53, being limited in the upward translation by the fins 529. As it migrates upwardly, progressively larger lateral offsets become possible, accomodating various surface irregularities in the well walls. This then, accomodates convenient tool passage past casing offsets, bulges, or doglegs.

Once brought to the desired well depth, water, at pressure, may be introduced through the tube string TS into fitting 521 and thence through a central drilling 631 in segment 52 into a set of radial ports 641 therein. In a manner similar to the device 10 a secondary, equalization, manifold 761 is also formed in segment 52 ported at ports 751 adjacent the sealing surface 522.

In this manner a water cleaning assembly is provided which accomodates surface irregularities in a well casing.

Obviously many modifications and changes may be made to the foregoing description without departing from the spirit of the invention. It is therefore intended that the scope of the invention be determined solely on the claims appended hereto.

What is claimed is:

1. A well bore cleaning assembly comprising:

a substantially cylindrical mandrel structure including an upper mandrel segment and a lower mandrel segment attached in axial alignment to said upper mandrel segment, said upper mandrel segment including a reduced section proximate the free end thereof and said lower segment being formed as a frustoconical structure over a portion thereof, the narrower part of said frustoconical structure being attached to said upper segment, said lower segment further including a cylindrical portion proximate the free end thereof;

an upper annular seal assembly mounted in substantially coaxial alignment on said reduced section said upper mandrel segment, said upper annular seal assembly comprising an upper resilient seal shaped in the manner of a frustoconical tubular segment provided with an annular base, and an upper collar conformed to engage the annulus of said base mounted on said reduced section to align said upper resilient seal towards said lower segment;

a lower annular seal assembly mounted in surrounding alignment on said lower mandrel segment, said lower annular seal assembly comprising a lower resilient seal shaped in the manner of a frustoconical tubular segment provided with an annular base, and a lower collar conformed to engage the annulus of said base, mounted to surround said lower segment to align said lower resilient seal towards said upper segment;

a source of pressurized fluid;

conveying means connected to said source for conveying said pressurized fluid through said upper segment; and sealing means formed on said reduced section and on said cylindrical portion for effecting a sealing engagement with said upper and lower seal assembly, respectively at selected displacements in the axial translation thereof.

2. Application according to claim 1 wherein said sealing means includes a plurality of sealing rings formed on said cylindrical portion.

3. Application according to claim 2 wherein said upper and lower resilient seal are each selected for sealing expansion against said well bore.

* * * * *